US006536354B1

(12) United States Patent
Madison et al.

(10) Patent No.: US 6,536,354 B1
(45) Date of Patent: Mar. 25, 2003

(54) RAILWAY TIE BED SCARIFIER

(75) Inventors: Harry Madison, Mt. Pleasant, SC (US); Jarud Hoefker, Fairmont, MN (US)

(73) Assignee: Harsco Technologies Corporation, Fairmont, MN (US)

( * ) Notice: Subject to any disclaimer, the term of this patent is extended or adjusted under 35 U.S.C. 154(b) by 0 days.

(21) Appl. No.: 09/994,976

(22) Filed: Nov. 26, 2001

(51) Int. Cl.[7] ..... E02F 5/00
(52) U.S. Cl. ..... 104/2; 37/104
(58) Field of Search ..... 104/2, 5, 6, 7.3, 104/9; 37/104

(56) References Cited

U.S. PATENT DOCUMENTS 1,691,933 A * 11/1928 Ovemier ..... 37/104
2,242,793 A * 5/1941 Philbrick ..... 37/104
2,616,192 A * 11/1952 Philbrick ..... 37/104
2,991,988 A * 7/1961 Kershaw ..... 37/104
4,102,066 A 7/1978 Christoff
4,403,430 A 9/1983 Valditerra
4,561,198 A 12/1985 Holley
4,850,123 A * 7/1989 Whitaker, Jr. ..... 171/16
5,125,345 A 6/1992 Theurer et al.
5,926,981 A 7/1999 Theurer

* cited by examiner

*Primary Examiner*—Mark T. Le
(74) *Attorney, Agent, or Firm*—William F. Lang, IV; Eckert Seamans Cherin & Mellott, LLC

(57) ABSTRACT

A railway tie bed scarifier mounts on a tie remover/inserter machine. The tie bed scarifier is dimensioned and configured to widen the pre-existing channels left in the ballast through the removal of old ties. The tie bed scarifier includes a carriage moving between a raised travel position and a lowered work position, and a pair of tines reciprocating between a retracted position wherein they fit between the rails, and an extended position wherein they extend towards the sides of the ballast. A method of inserting a railway tie is also provided.

5 Claims, 6 Drawing Sheets

RAILWAY TIE BED SCARIFIER

BACKGROUND OF THE INVENTION

1. Field of the Invention

The present invention relates to an apparatus and method for scarifying a railway tie bed, thereby providing sufficient space within the ballast for insertion of a replacement railway tie. More specifically, the present invention includes a scarifier capable of being mounted on a tie insertion/removal vehicle.

2. Description of the Related Art

Scarifying is a step in the process of removing and replacing old railway ties, wherein some of the ballast immediately surrounding the space formerly occupied by the old tie is removed, thereby providing additional space for insertion of the new tie. Although the present trend is to minimize the frequency with which this step is performed, scarifying is still helpful in locations wherein the ballast has been compacted and/or contaminated, resulting in excessive difficulty in inserting the new tie.

One proposed system of displacing ballast includes a pointed plow having a plurality of lateral ejectors, with each ejector reciprocating between a first position wherein one end of the ejector protrudes from the plow, and the opposite end is retracted, and a second position wherein the previously retracted end of the ejector is now extended, and the first end of the ejector is retracted within the plow. The lateral ejectors may be actuated in pairs, so that when one ejector is moved towards one side of the plow, a corresponding ejector is moved towards the opposite side of the plow.

Another proposed scarifying device includes horizontally and vertically reciprocating ballast clearing elements. The ballast clearing elements are moved vertically by a vertical displacement drive and vertical displacement guides. The ballast clearing elements and associated carrier are moved horizontally as a unit. The ballast clearing elements are pivotally secured to the carrier at their top ends, permitting them to pivot upward and outward.

Yet another proposed scarifying device includes a rotating drum having a plurality of pivotally attached hammer arms. Each hammer arm includes tool at its end for removing ballast, and a tie protecting portion on its front surface. As the drum rotates, the hammer arms are pulled outward by centrifugal force, causing the tooth of the hammer to strike the ballast, thereby removing the ballast from the desired location. When the rotating drum passes over a tie, the tie protecting portion of the hammer will strike the tie before the tooth, causing the hammer to be deflected towards the drum, preventing the tooth from damaging the tie.

Lastly, another scarifying apparatus includes three digging plates, with one digging plate extending between the tracks, and the other two digging plates each located on one side of the tracks.

The majority of the presently proposed scarifying devices are therefore designed to remove significantly greater amounts of ballast than the small amount necessary to widen the channel within the ballast previously occupied by the old tie, thereby permitting insertion of a new railway tie. Additionally, presently available scarifying devices are not particularly suited to mounting on a tie inserting/removal machine.

Accordingly, a scarifying device adapted for mounting on a tie remover/inserter machine is desired. Additionally, a scarifier having laterally reciprocating tines for removing ballast only immediately adjacent to the space occupied by an old railway tie is desired.

SUMMARY OF THE INVENTION

The present invention is a railway tie bed scarifier capable of being mounted on a tie remover/inserter machine, and being adapted to remove only that ballast immediately around the space wherein an old tie was formerly located.

The tie bed scarifier includes a plurality of tines, with a preferred number being four, supported by a carriage. The carriage is adapted to be raised into a travel position, and lowered into a work position. In the travel position, the tines are sufficiently raised to clear the railway tracks. In the work position, the tines are positioned slightly below the rails. The tines are mounted on the carriage so that they may reciprocate back and forth within the space to be occupied by a tie, perpendicular to the rails. A preferred configuration of tines includes four tines, with two adapted to travel towards one rail, and the other two adapted to travel towards the other rail. Preferably, the two tines adapted to travel in one direction will be located at opposing sides of the channel within the ballast.

In use, the scarifier will be in its raised travel position until needed. When the scarifier is needed, the tie remover/inserter machine will be moved so that the scarifier is directly over the channel in the ballast wherein an old tie was formerly located. The carriage will be lowered from the travel position to the work position, with the tines kept in their retracted position so that they pass between the tracks. Once the carriage is in the work position, the tines are extended and retracted within the channel left by the removed tie, thereby widening the channel. Once the channel within the ballast has been sufficiently widened, the tines are retracted, the carriage is raised to its travel position, and the tie remover/inserter machine travels sufficiently so that the tie removal/insertion arm is adjacent to the channel.

It is therefore an aspect of the present invention to provide a railway tie bed scarifier capable of being mounted on a tie remover/inserter machine.

It is another aspect of the present invention to provide a tie bed scarifier specifically adapted to widen pre-existing channels left within the ballast by the removal of old ties.

It is a further aspect of the present invention to provide a tie bed scarifier having a simplified design with respect to presently available scarifiers It is another aspect of the present invention to provide an improved tie insertion method.

These and other aspects of the invention will become apparent through the following description and drawings.

BRIEF DESCRIPTION OF THE DRAWINGS

Like reference numbers denote like elements throughout the drawings.

DETAILED DESCRIPTION

The present invention is a railway tie bed scarifier for enlarging a channel within a railway track's ballast to facilitate insertion of a tie, and an associated method of inserting a tie. The scarifier of the present invention has the advantage of being mountable on a tie insertion/removal machine. The scarifier is bet understood through a brief description of a tie insertion vehicle and process.

Figure 1:
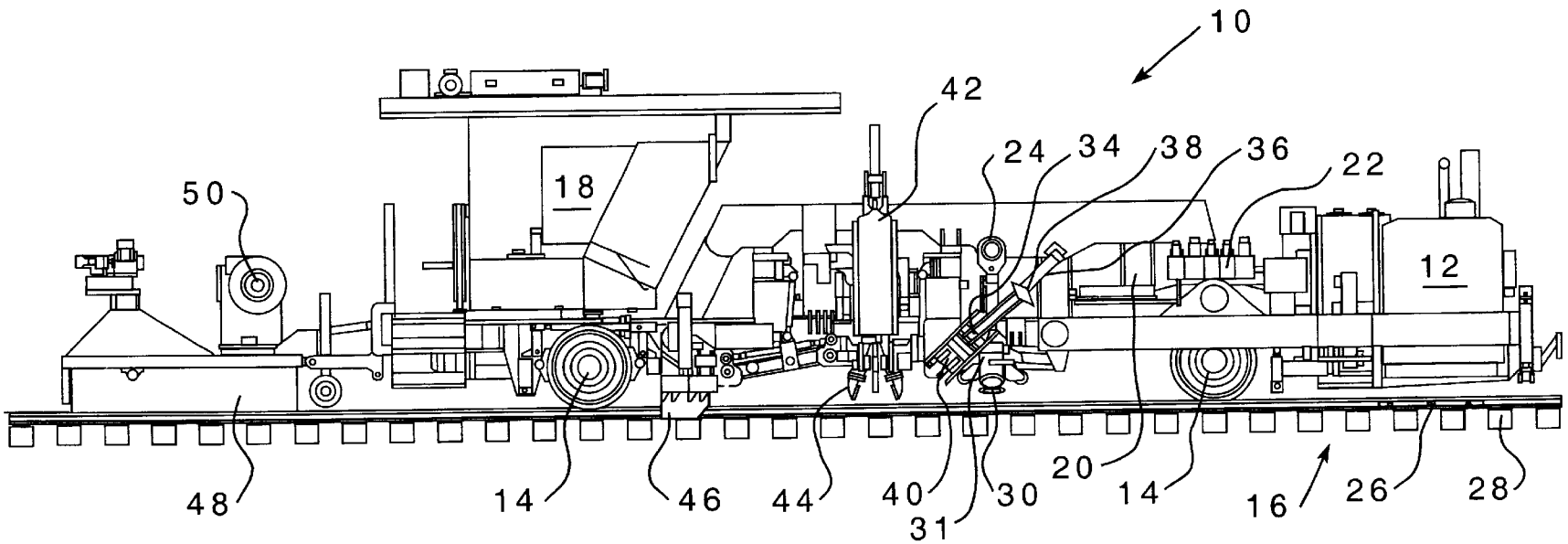
FIG. 1 is a side view of a tie remover/inserter machine with which the railway tie bed scarifier of the present invention will be used.

FIG. 1 illustrates a railway tie insertion vehicle 10. The tie insertion vehicle 10 includes an engine 12 for moving the vehicle 10 and supplying power to its various components, a plurality of wheels 14 for moving the vehicle 10 along the tracks 16, and an operator's cab 18 from which the vehicle 10 and its various components are controlled. The engine 12 supplies power for operation of the hydraulic power system utilized to operate the various components of the vehicle 10, with the hydraulic power system including a hydraulic fluid storage cylinder 20, operatively connected with a plurality of valves 22 for channeling the hydraulic fluid to the various components of the vehicle 10.

The vehicle 10 includes a pair of rail clamps 24, dimensioned and configured to lift the rails 26 of the tracks 16 sufficiently to permit insertion and removal of the ties 28 beneath the rails 26 and tie plates 29, supporting the rails 26 on the ties 28. The rail clamp 24 includes a plurality of rollers 30 at the bottom end of a pair of scissor arms 31, dimensioned and configured to grab the rail 26 from both sides beneath the rail's ball 32 (best illustrated in FIGS. 3 and 5). In use, the rollers 30 will be placed on either side of the rails 26, beneath the ball 32, and the rail clamp 24 will be raised, causing the scissor arms 31 to tighten around the rail 26, and enabling the rail clamp 24 to deflect the rail 26 upward, typically approximately 1–2 inches. The rollers 30 permit the rail clamp 24 to remain clamped to the rail 26, raising the rail 26 upward, as the vehicle 10 moves forward from tie 28 to tie 28 along the track 16.

A tie kicker 34 is located near the rail clamp 24. The tie kicker 34 includes an arm 36 having a striking plate 38 at one end, which is pivotally secured to the vehicle 10 at its other end 40. In use, the arm 36 will pivot around the point 40 so that the striking plate 38 strikes a tie 28, thereby pushing the tie 28 partially out from underneath the rails 26 and out from the ballast surrounding the tie 28. The tie kicker 34 is used in conjunction with the tie boom 42 to remove old ties.

The tie boom 42 includes multiple telescoping sections, and terminates in a tie clamp 44, dimensioned and configured to grasp a tie 28. An example number of telescoping sections for the tie boom 42 is three, with these three sections extending horizontally, substantially parallel to the ties 28. The tie clamp 44 is dimensioned and configured to be raised and lowered between a raised travel position and a lowered position wherein a tie 28 may be grasped. The tie boom 42 may be used to either insert new ties, or to remove old ties. To remove an old tie, the tie boom 42 is extended so that the tie clamp 44 is positioned above a portion of the tie 28 that may easily be grasped, the tie clamp 44 is lowered and closed around the tie 28, and the tie boom 42 is then extended outward to slide the old tie 28 out from underneath the rails 26, in a direction substantially parallel to the rail 28. The old tie 28 may then be released by the tie clamp 44, and left along side the track for later disposal. To insert a new tie, the tie boom 42 is first extended outward to a position wherein the tie clamp 44 is substantially directly above a new tie 28, previously deposited along side the track 16. The tie clamp 44 is lowered to a position wherein it may grasp the tie 28. After the tie 28 is grasped, the tie clamp 44 is raised to a position wherein the tie 28 is aligned with a channel in the ballast surround the ties that has been left by removal of the previous tie, and the tie boom 42 is retracted to insert the new tie 28 underneath the tracks 26.

The vehicle 10 also may include a ballast plow 46, which may be lowered onto the tops of the ties 28 for removing ballast displaced during the tie insertion process, and/or a tie broom 48, which may include a suction apparatus 50, also for removing displaced ballast from the rails 26 and ties 28.

Prior railway tie replacement processes frequently included the step of scarifying the channel left in the ballast after removal of the old tie, thereby widening and deepening the channel for ease of inserting the new tie into the channel. Presently used tie replacement methods generally do not use the scarifying step, but this step still remains beneficial in locations where the ballast has either been compacted or contaminated, for example, at road crossings, bridges, and switches, resulting in excessive difficulty in inserting the new tie. Because the scarifying step is used only for a limited number of occasions, having a dedicated scarifying machine is no longer advantageous. Therefore, the present invention provides a scarifier capable of being mounted on a typical tie removal/insertion machine 10.

Referring to FIGS. 2–6, a scarifier 52 of the present invention includes a carriage 54 at one end of a positioning arm 56. The carriage 54 includes at least two scarifying tines 58, 60, with one scarifying tine 58 dimensioned and configured to remove ballast while moving towards one of the rails 26, and the other scarifying tine 60 being dimensioned and configured to remove ballast when moved in the direction of the opposite rail 26. The illustrated example includes four scarifying tines 58, 60, with two tines 58 being dimensioned and configured to remove ballast in the direction towards one rail 26, and the other two tines 60 being dimensioned and configured to remove ballast when moving towards the opposite rail 26. The scarifying tines 58, 60 each correspond to one-half of one side of the channel within the ballast for containing a tie 28. The carriage 54 also includes means for moving the scarifying tines 58, 60 between a retracted position wherein the carriage 54 may be raised and lowered between the rails 26 without interference between the tines 58, 60 and the rails 26, and an extended position wherein the scarifying tines 58, 60 extend beneath the rails 26. In the illustrated example, the means for moving the scarifying tines 58, 60 between their extended and retracted positions are the hydraulic cylinders 62, 64, with the hydraulic cylinder 62 being dimensioned and configured to move the tines 58, and the hydraulic cylinder 64 being dimensioned and configured to move the tines 60.

The carriage 54 may include means for adjusting the height of the scarifying tines 58, 60 with respect to the carriage 54. In the illustrated example, the carriage includes a pair of shim holders 66, dimensioned and configured to contain a plurality of removable shims 68, with the shims 68 secured in place by a pin 70. By inserting and removing some of the shims 68 between the carriage 54 and the top surface 72 of the tine assembly 74 (including the tines 58, 60, and hydraulic cylinders 62, 64), the height of the tine assembly 74 with respect to the carriage 54 may be adjusted, so that for a given height of rail 26, when the bottom of the shim holders 66 rests on the ball 32 of the rails 26, the scarifying tines 58, 60 will be located directly underneath the tie plates 29 of the rails 26. Other alternative means of adjusting the height of the scarifying tines 58, 60 with respect to the carriage 54 may be used, with examples including threaded rods or electronically positioned hydraulic cylinders.

Figure 3:
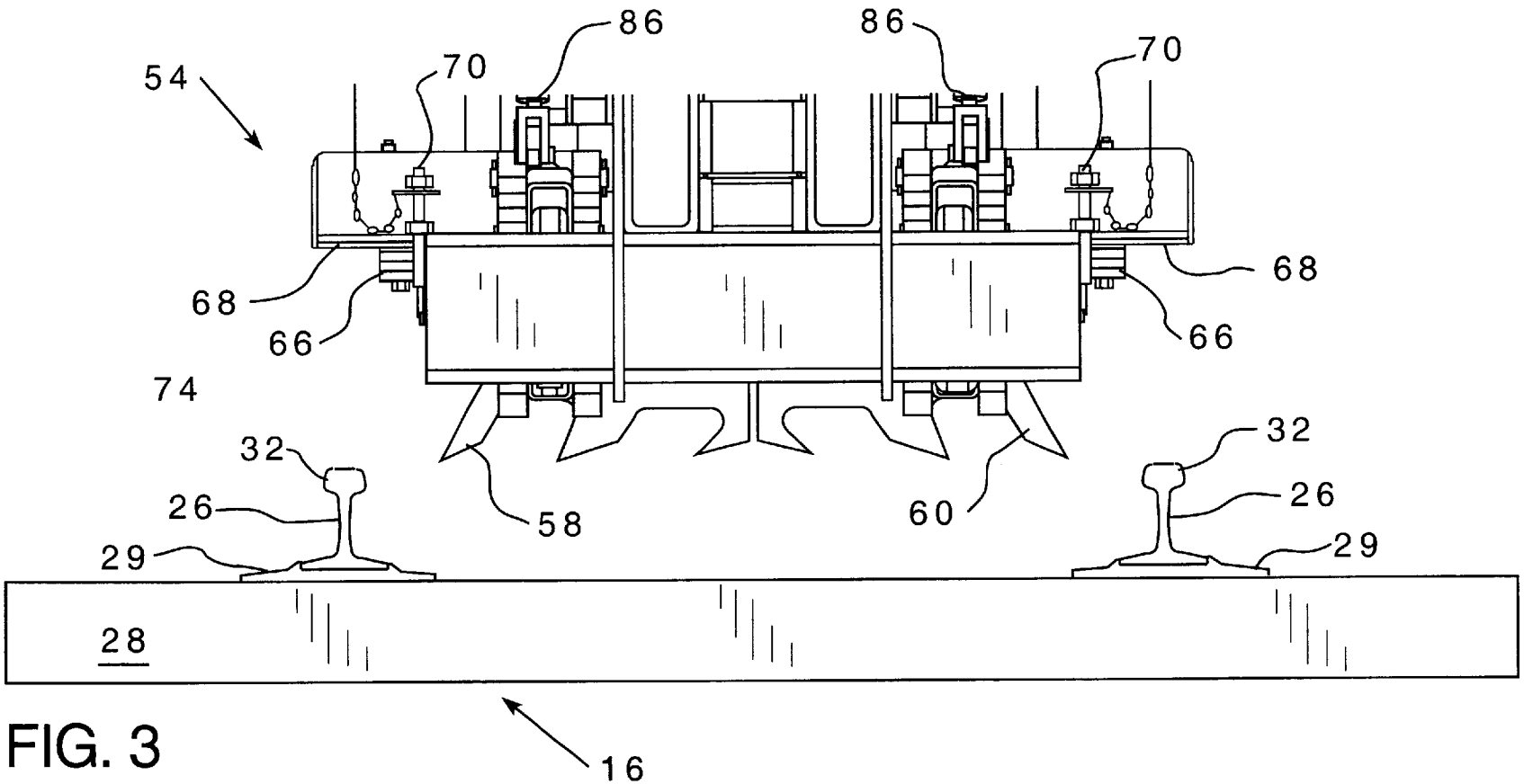
FIG. 3 is a front view of a tie bed scarifier according to the present invention, showing the carriage in its raised travel position.
Figure 4:
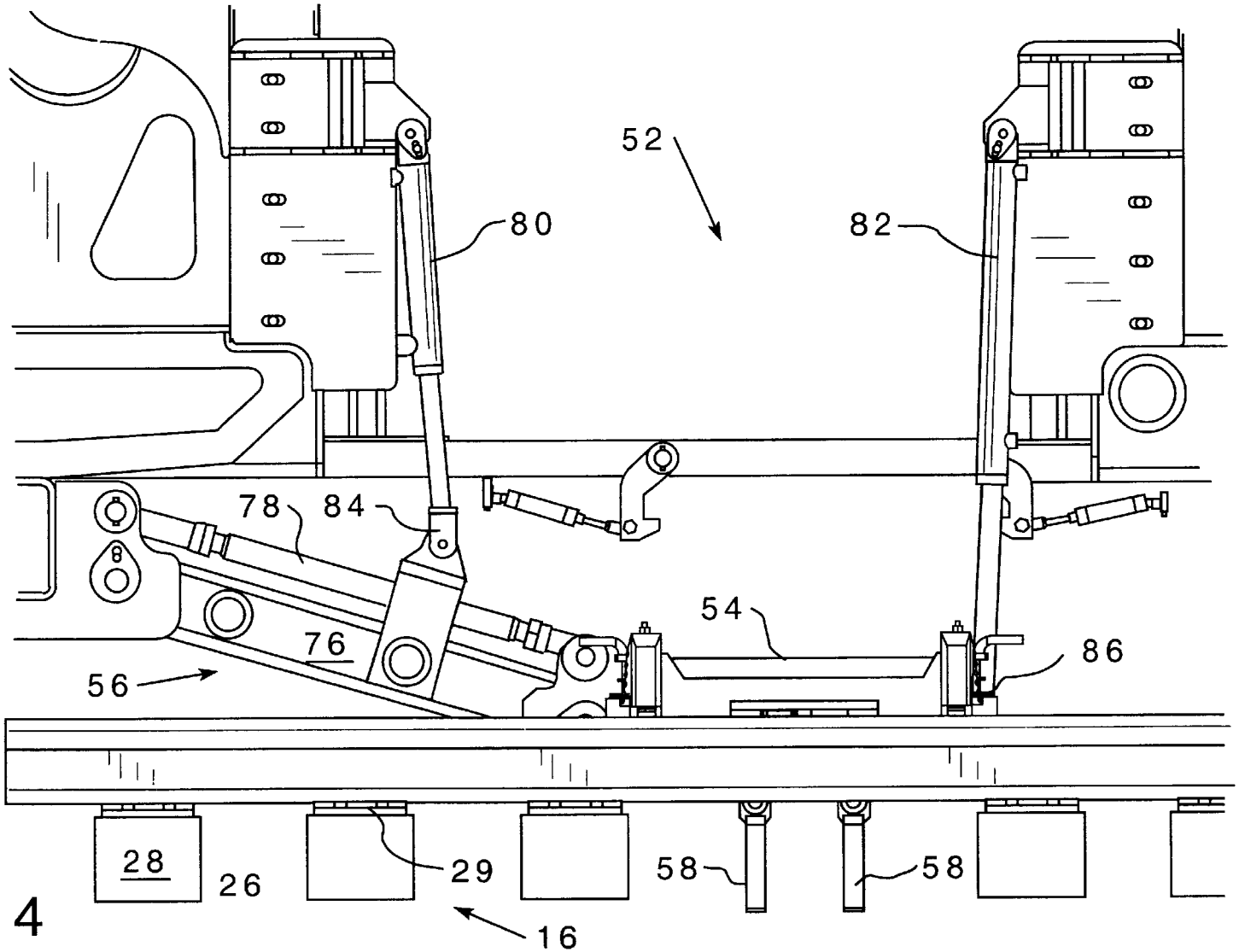
FIG. 4 is a side view of a tie bed scarifier according to the present invention, showing the carriage in its lowered work position.
Figure 5:
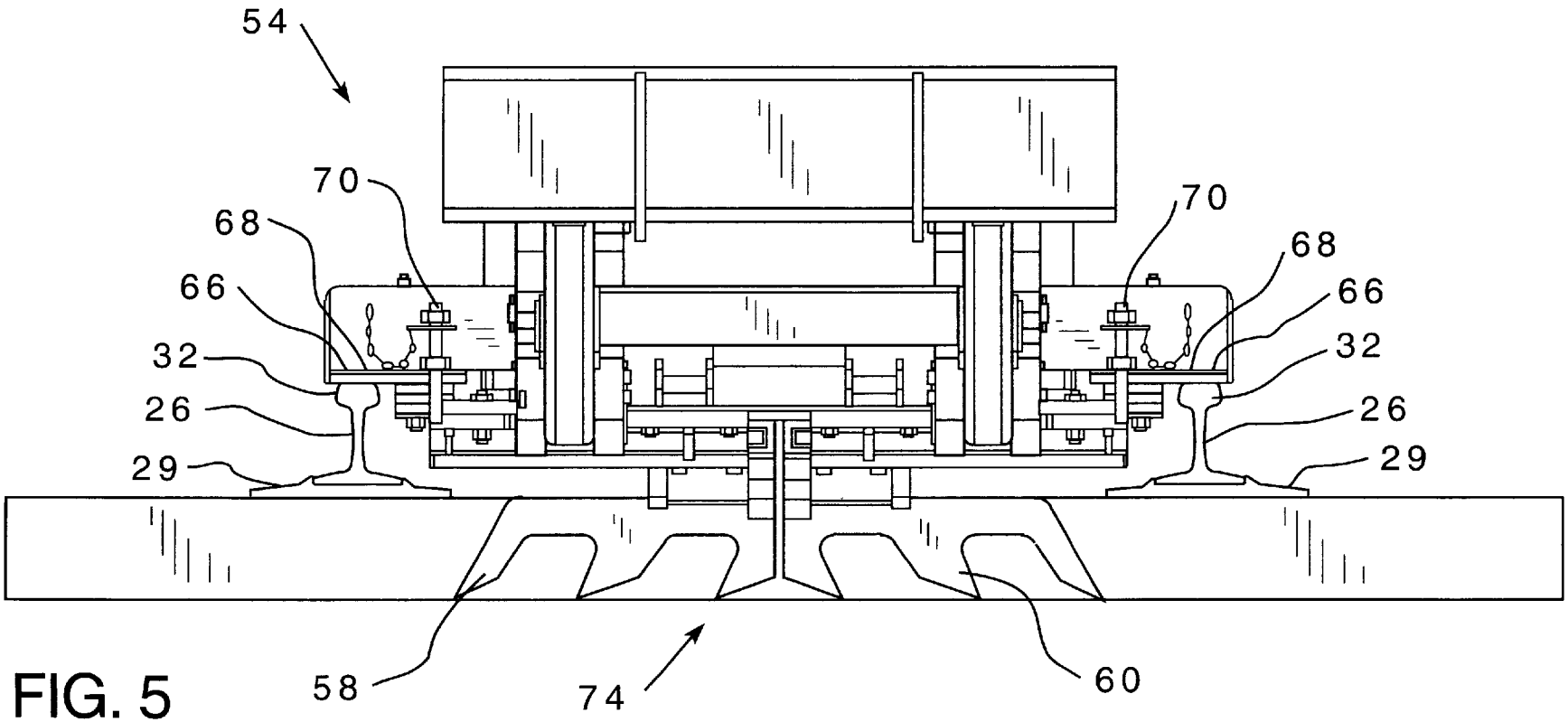
FIG. 5 is a front view of a tie bed scarifier according to the present invention, showing the carriage in its work position and the tines in their retracted position.
Figure 6:
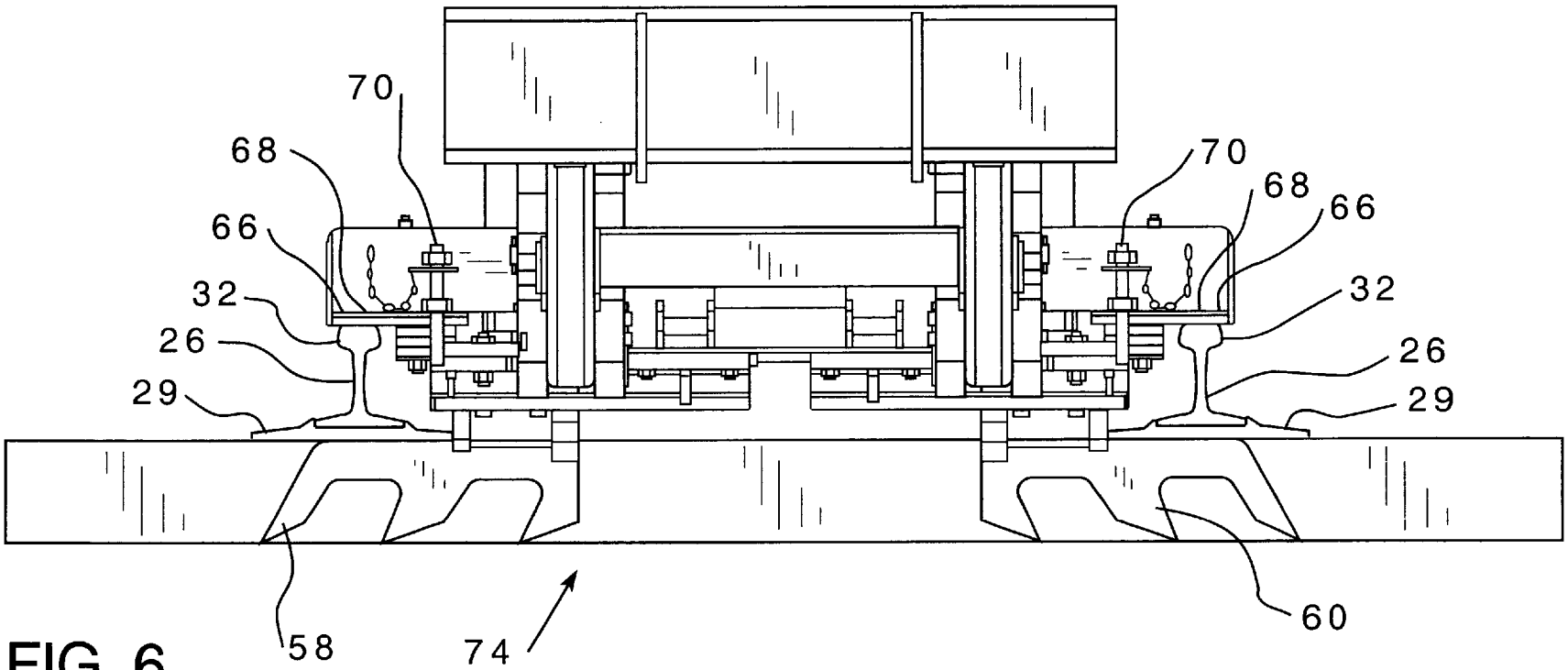
FIG. 6 is a front view of a tie bed scarifier according to the present invention, showing the carriage in its work position and the tines in their extended position.

The positioning arm 56 is dimensioned and configured to guide the movement of the carriage 54 between a raised, travel position (FIGS. 2–3), and a lowered, working position (FIGS. 4–6). This may be accomplished by a positioning arm 56 having four elongated, substantially parallel members, pivotally secured to the carriage 54 at one end and to the tie insertion/removal vehicle 10 at the opposite end. Two of the four arm members, in the illustrated example, the bottom two members, will be support members 76 having a fixed length. The arm 56 preferably also includes a pair of guide members 78, in the present example, the top two members of the arm 56. The guide members 78 preferably have an adjustable length. The use of the fixed length support members 76 and adjustable length guide members 78 permits the carriage 54 to remain substantially horizontal whether in its raised position, lowered position, or anywhere in between.

The scarifier also includes means for raising and lowering the carriage 54, which in the present example are at least two hydraulic cylinders 80, 82. At least one hydraulic cylinder 80, in the illustrated example, two hydraulic cylinders 80, are pivotally secured between the tie insertion vehicle 10 and the arm 56 at 84. Likewise, at least one hydraulic cylinder 82 is pivotally secured between the tie insertion vehicle 10 and the carriage 54 at the carriage's side 86, opposite the arm 56. In the illustrated example, two hydraulic cylinders 82 are used.

Figure 2:
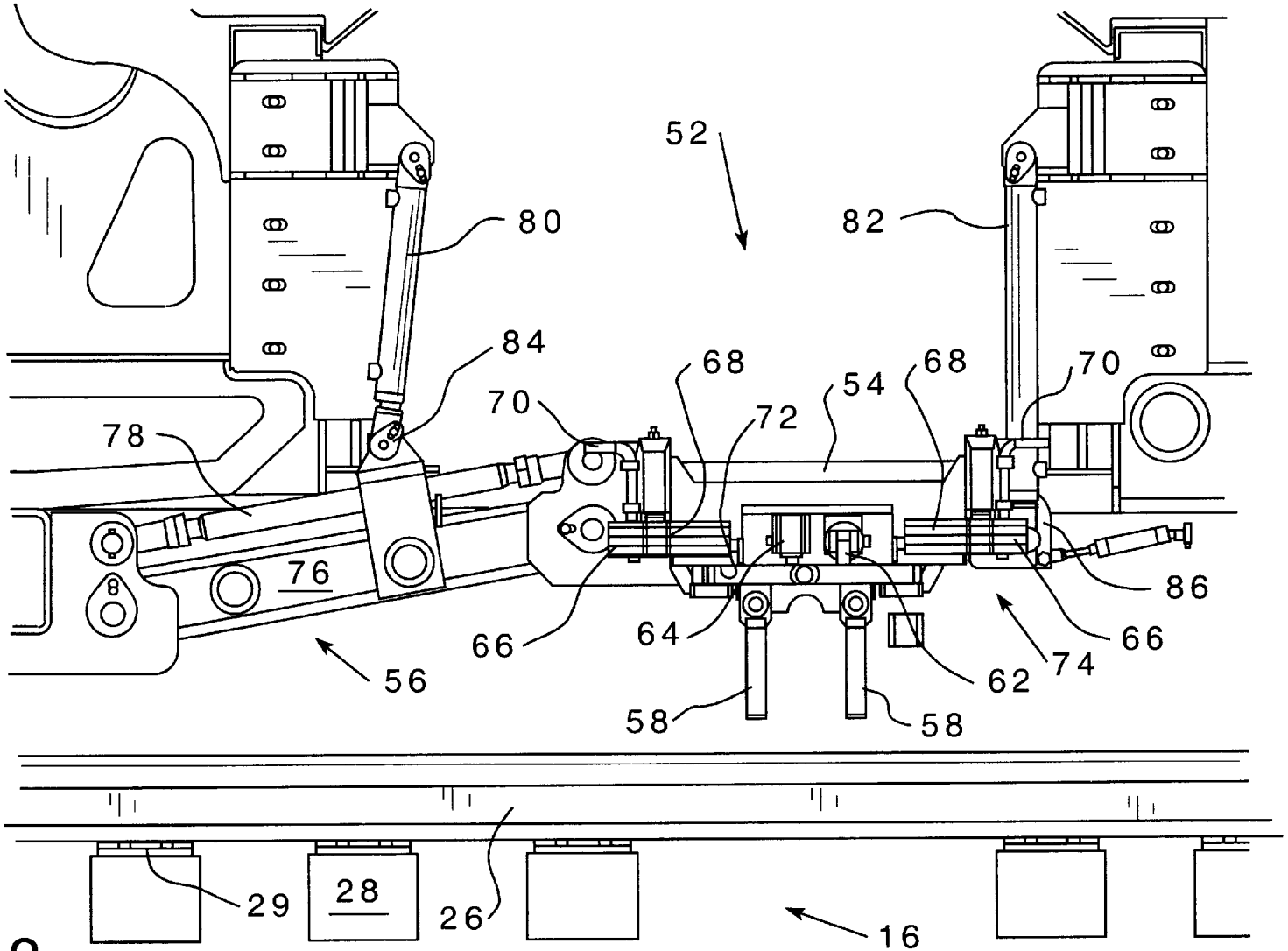
FIG. 2 is a side view of a railway tie bed scarifier according to the present invention, showing the carriage in its raised travel position.

In use, the carriage 54 will remain in its raised position (FIGS. 2–3) until it is desired to scarify a channel within the ballast to facilitate insertion of a new tie 28. The carriage 54 will be lowered from its raised position to its lowered position (FIGS. 4–5), wherein the scarifying tines 58, 60 contact the ballast where the location of the new tie 28 is desired. The tines 58, 60 are then repeatedly extended and retracted (FIGS. 5–6) between the rails 26 and tie plates 29, as the hydraulic cylinders 80, 82 continue to push downward on the arm 56 and carriage 54, until a channel of sufficient size for easy insertion of a new tie 28 has been formed. The tines 58, 60 are then moved to their retracted position (FIG. 5), so that the carriage 54 may be raised back up into its travel position (FIGS. 2–3).

While a specific embodiment of the invention has been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A railway tie bed scarifier, the railway having a pair of substantially parallel rails defining a distance therebetween, a plurality of ties under and substantially perpendicular to said rails, and ballast surrounding said ties, said scarifier comprising:

a carriage movable between a raised position and a lowered position, said carriage being dimensioned and configured for mounting on a tie insertion/removal vehicle, said carriage further comprising a positioning arm having at least one fixed length support member and at least one adjustable length guide member corresponding to and substantially parallel to the fixed length member, the support member and guide member each having a first end pivotally secured to the carriage, and a second end opposite said carriage, with the second end being dimensioned and configured for mounting on a tie insertion/removal vehicle, said carriage further including means for moving said carriage between a lowered position and a raised position, said means being dimensioned and configured for connection between said positioning arm and a vehicle; and at least two tines slidably secured to said carriage, reciprocable parallel to said ties between a retracted position wherein said carriage may be raised and lowered without interference between said scarifier and the rails, and an extended position wherein each of said at least two tines extends under one of the rails, said tines being dimensioned and configured to create a channel within said ballast sufficiently wide to permit insertion of a tie into said channel when said tines are reciprocated within said ballast.

2. The railway tie bed scarifier according to claim 1, wherein said positioning arm includes a pair of fixed length support members and a pair of adjustable length guide members.

3. The railway tie bed scarifier according to claim 1, wherein said means for moving said carriage include a first hydraulic cylinder dimensioned and configured to actuate movement of said arm, and to resist upward movement of said carriage when said carriage is in said lowered position.

4. The railway tie bed scarifier according to claim 3, wherein said means for moving said carriage include a second hydraulic cylinder dimensioned and configured to actuate movement of said carriage, and to resist upward movement of said carriage when said carriage is in said lowered position.

5. The railway tie bed scarifier according to claim 1, wherein said at least 2 tines are at least four in number, two of said four tines passing under one rail when in said extended position, and 2 of said tines passing under the other rail when in said extended position.

* * * * *